United States Patent [19]

Takada et al.

[11] Patent Number: 4,917,778

[45] Date of Patent: Apr. 17, 1990

[54] PROCESS FOR THE CORROSION PROTECTION OF NEODYMIUM-IRON-BORON GROUP SINTERED MAGNETS

[75] Inventors: Koji Takada, Nagoya; Yutaro Etizen, Kawaguchi, both of Japan

[73] Assignee: Yugen Kaisha Johoku Riken Kogyo, Japan

[21] Appl. No.: 423,974

[22] Filed: Oct. 19, 1989

[30] Foreign Application Priority Data

May 26, 1989 [JP] Japan ..... 1-131580

[51] Int. Cl.[4] ..... C25D 5/34; C25D 13/04

[52] U.S. Cl. ..... 204/32.1; 204/38.7; 204/181.1

[58] Field of Search ..... 204/29, 32.1, 38.7, 204/181.1

[56] References Cited

U.S. PATENT DOCUMENTS

| | | | |
|---|---|---|---|
| 4,837,114 | 6/1989 | Hamada et al. | 427/127 |
| 4,857,873 | 8/1989 | Gillings | 335/285 |
| 4,863,805 | 9/1989 | Suzuki et al. | 428/558 |

*Primary Examiner*—John F. Niebling
*Assistant Examiner*—William Leader
*Attorney, Agent, or Firm*—Kane, Dalsimer, Sullivan, Kurucz, Levy, Eisele and Richard

[57] ABSTRACT

Disclosed is a process for the corrosion protection of a neodymium-iron-boron group sintered magnet, which comprises the steps of: immersing the neodymium-iron-boron group sintered magnet in oxidizing acid to activate the surface thereof; plating the magnet with nickel having internal stress of not more than 1000 kgf/cm$^2$; and applying cationic electrodeposition coating thereto.

1 Claim, No Drawings

PROCESS FOR THE CORROSION PROTECTION OF NEODYMIUM-IRON-BORON GROUP SINTERED MAGNETS

BACKGROUND OF THE INVENTION

1. Field of the Invention

The present invention relates to a surface treatment process for the corrosion protection of neodymium-iron-boron group sintered magnets.

2. Prior Art

Neodymium-iron-boron group magnets are rare-earth magnets having high magnetic flux density and high coercive force and are in great demand. However, this type magnets corrode easily. Furthermore, this type magnets have a tendency to be embrittled with absorption of hydrogen produced in corrosion reaction caused by the fact that neodymium is a strongly hydrogen absorbing metal. Therefore, the establishment of a perfect corrosion protection process has been required because the conventionally known process has the following disadvantages.

If corrosion protection plating such as zinc plating or cadmium plating is applied to the neodymium-iron-boron group sintered magnets, embrittlement occurs with absorption of hydrogen produced during electrolysis. If electrostatic painting or powder coating is applied to this type magnets, water penetrates paint film to react on the base metal thereof. If cationic electrodeposition coating which is, in general, a coating process most excellent in corrosion resistance is applied, sufficient corrosion protection effect cannot be obtained.

SUMMARY OF THE INVENTION

It is therefore an object of the present invention to solve the aforementioned problem in the prior art.

It is another object of the present invention to provide a corrosion protection process by which neodymium-iron-boron group sintered magnets as base metals can be protected from corrosion and hydrogen embrittlement in any corrosion environment.

DETAILED DESCRIPTION OF THE INVENTION

The inventors have conducted investigation eagerly to attain the foregoing objects. As the result of investigation, it has been found that good corrosion resistance can be obtained by applying cationic electrodeposition coating to neodymium-iron-boron group sintered magnets after applying nickel plating. In general, a pretreatment of activating the surface of a subject to be plated is required for application of nickel plating. If non-oxidizing acid such as hydrochloric acid or sulfuric acid is used for the activating pretreatment, hydrogen is produced and absorbed into a neodymium-iron-boron group alloy to thereby cause disintegration due to hydrogen embrittlement. Therefore, it has been found that oxidizing acid is effective for activation. Further, it has been found that nickel plating is peculiarly effective as plating applied to neodymium-iron-boron group sintered magnets, because the number of hydrogen atoms produced during electrolysis is so small that the hydrogen overvoltage is low. Further, it has been confirmed that nickel plating film having low internal stress is required and that nickel plating film having high internal stress cannot perfectly adhere to neodymium-iron-boron group sintered magnets. The present invention has been completed with confirmation that perfect corrosion protection film can be formed on neodymium-iron-boron group sintered magnets by a process comprising the steps of performing activating pretreatment with oxidizing acid as described above, applying low-stress nickel plating, and applying cationic electrodeposition coating.

In short, the present invention provides a process for the corrosion protection of a neodymium-iron-boron group sintered magnet which comprises the steps of: immersing the neodymium-iron-boron group sintered magnet in oxidizing acid to activate the surface thereof; plating the magnet with nickel having internal stress of not more than 1000 kgf/cm$^2$; and applying cationic electrodeposition coating thereto.

Acid used for activating the surface of the neodymium-iron-boron group sintered magnet is selected from oxidizing acids. Non-oxidizing acids are unsuited for use because hydrogen embrittlement occurs. Oxidizing acids used herein are nitric acid, persulfuric acid and perchloric acid. The preferred is nitric acid.

When nitric acid is used as oxidizing acid, the nitric acid is preferably used in the form of an aqueous solution ranging in concentration from 10 to 20% by volume. If the concentration is less than 10% by volume, oxidizing power is so insufficient that hydrogen embrittlement may occue. If the concentration is more than 20% by volume, the corrosive action of the acid is undesirably severe.

It is, in particular, preferable that the immersing period for activation is from 30 to 180 seconds.

Nickel plating needs to be made with low internal stress. In particular, the internal stress is not motre than 1000 kgf/cm$^2$. If the internal stress of nickel plating is more than 1000 kgf/cm$^2$, plating film cannot perfectly adhere to the neodymium-iron-boron group sintered magnet as a base metal, so that peeling of plating film occurs and, consequently, corrosion protection effect cannot be attained. Accordingly, a brightener or the like for increasing the internal stress of plating film need not be added into a nickel plating bath used in the present invention. If necessary, a Watt's bath or a sulfamate bath including a stress reducing agent may be used.

The cationic electrodeposition coating after nickel plating can be made by an ordinary method.

Because neodymium-iron-boron group magnets corrode easily, the perfect corrosion protection thereof cannot be made by any conventional process. For example, in the case where only nickel plating is applied to this type magnet, red rust is produced after several hours in salt spray test and, accordingly, disintegration caused by hydrogen embrittlement owing to corrosion reaction occurs.

On the other hand, in the case where only cationic electro-deposition coating is applied to this type magnet, the magnet does not pass the following tests: blisters of paint film together with red rust are produced after 48 hours in salt spray test; blisters of paint film are produced after 96 hours in humidity test under the conditions of a relative humidity of 85% and a temperature of 85° C. When the corrosion protection process according to the present invention is applied to the neodymium-iron-boron group sintered magnet, a perfect corrosion protection effect can be attained as follows: abnormality is not found for 1000 hours in salt spray test; the magnet passes humidity test under the conditions of a relative humidity of 85% and a temperature of 85° C. for 2000 hours.

In short, a corrosion protection effect cannot be attained by only applying nickel plating to the neodymium-iron boron group sintered magnet or by only applying cationic electro-deposition coating thereto. It is, however, apparent that an unexpected great corrosion protection effect can be attained by applying composite film of nickel plating and cationic electrodeposition coating to this type magnet.

The invention will be described more in detail with reference to the following example.

EXAMPLE

The chemical composition of the neodymium-iron-boron group sintered magnet used in the example of the present invention was as follows:

Neodymium 29.8%, iron 62.4%, boron 1.1%, dysprosium 3.6%, praseodymium 0.7%, and manganese 0.1%.

The neodymium-iron-boron group sintered magnet was immersed in 15% by volume of nitric acid at an ordinary temperature for 60 seconds to carry out activation. Then, the magnet was plated with nickel in a nickel plating bath having the following composition.

| Composition of Nickel Plating Bath and Plating Condition | |
|---|---|
| Nickel sulfate | 300 g/l |
| Nickel chloride | 60 g/l |
| Boric acid | 40 g/l |
| Sodium lauryl sulfate (anti-pitting agent) | 0.05 g/l |
| NTS (stress reducing agent) | 3.0 g/l |
| (NTS represents sodium naphthalene-1,3,6-trisulfonate.) | |
| Bath temperature | 40–50° C. |
| Current density | 3 A/dm$^2$ |
| Plating period | 25 minutes |

The internal stress of the nickel plating film measured by a spiral contract meter (internal stress measuring apparatus) was tensile stress of 600 kgf/cm$^2$.

Semiglossy smooth nickel plating having a thickness of 20 μm was obtained in the aforementioned composition of the plating bath and the plating condition. Then, cationic electrodeposition coating was applied onto the plating film by a known method.

In the cationic electrodeposition coating, electrodeposition was made with the bath voltage of 200 V at 3 minutes by use of "Radicoat N-800 (Tradename)" made by Nippon Paint Co., Ltd. and then baking was made at 200° C. for 30 minutes to prepare paint film having a thickness of 25 μm.

The neodymium-iron-boron group sintered magnet subjected to the corrosion protection treatment in accordance with the present invention proved the perfect corrosion protection effect of the invention as follows: abnormality was not found for 1000 hours in salt spray test in accordance with JIS-H8502; the magnet passed humidity test under the conditions of relative humidity of 85% and temperature of 85° C. for 2000 hours. As comparative examples, a neodymium-iron-boron group sintered magnet of the same composition subjected to only nickel plating and a neodymium-iron-boron group sintered magnet of the same composition subjected to only cationic electrodeposition coating were tested. In the case of the magnet subjected to only nickel plating, production of red rust was observed after 8 hours in salt spray test, and production of red rust and peeling of plating film were observed after 100 hours in humidity test. In the case of the magnet subjected to only cationic electrodeposition coating, blisters of paint film together with red rust were observed after 48 hours in salt spray test, and blisters of paint film were observed after 96 hours in humidity test.

It is apparent from the aforementioned example that the present invention can provide a corrosion protection process for giving perfect corrosion resistance to neodymium-iron-boron group sintered magnets which was very difficult to obtain in the prior art, and that the invention is useful in the industrial field.

What is claimed is:

1. A process for the corrosion protection of a neodymium-iron-boron group sintered magnet, which comprises the steps of:

immersing the neodymium-iron-boron group sintered magnet in oxidizing acid to activate the surface thereof; plating the magnet with nickel having internal stress of not more than 1000 kgf/cm$^2$; and applying cationic electrodeposition coating thereto.

* * * * *